US005810370A

United States Patent [19]

Covert et al.

[11] Patent Number: 5,810,370

[45] Date of Patent: Sep. 22, 1998

[54] SNOW BOARD BINDING

[76] Inventors: Richard P. Covert; David O. Williams, both of 1910 Casino Rd. W., #123, Everett, Wash. 98204

[21] Appl. No.: 613,437

[22] Filed: Mar. 4, 1996

[51] Int. Cl.[6] ..... A63C 9/00

[52] U.S. Cl. ..... 280/14.2; 280/607; 280/618; 441/70

[58] Field of Search ..... 280/14.2, 607, 280/608, 617, 618, 633, 634; 441/70

[56] References Cited

U.S. PATENT DOCUMENTS

| | | | |
|---|---|---|---|
| 3,750,204 | 8/1973 | Walter | 280/633 |
| 3,785,666 | 1/1974 | Pierre et al. | 280/633 |
| 4,264,087 | 4/1981 | Bortoli | 280/633 |
| 4,403,785 | 9/1983 | Hottel | 280/14.2 |
| 4,871,337 | 10/1989 | Harris | 280/14.2 |
| 5,028,068 | 7/1991 | Donovan | 280/618 |
| 5,035,443 | 7/1991 | Kincheloe | 280/618 |
| 5,143,395 | 9/1992 | Mayr | 280/617 |
| 5,354,088 | 10/1994 | Vetter et al. | 280/618 |
| 5,417,443 | 5/1995 | Blattner et al. | 280/14.2 |
| 5,584,492 | 12/1996 | Fardie | 280/618 |
| 5,660,410 | 8/1997 | Alden | 280/617 |

FOREIGN PATENT DOCUMENTS

| | | | |
|---|---|---|---|
| 398794 | 11/1990 | European Pat. Off. | 280/14.2 |
| 2645036 | 10/1990 | France | 280/14.2 |
| 684056 | 7/1994 | Switzerland | 280/617 |

*Primary Examiner*—Brian L. Johnson
*Assistant Examiner*—Frank Vanaman
*Attorney, Agent, or Firm*—Jensen & Puntigam, P.S.

[57] ABSTRACT

A binding system for snow boards, including a pair of parallel strips along each edge of the board including opposing grooves and a frame element adjustably mounted between the strips secured within the grooves such that both the relative angle and the position along the length of the board may be varied. The securement elements for the boot holding straps are adjustable along the side of the frame to accommodate different boot sizes.

3 Claims, 3 Drawing Sheets

SNOW BOARD BINDING

TECHNICAL FIELD

The present invention relates to binding devices for securing a shoe or boot to a snow board, and more particularly, a binding which is angularly adjustable and adjustable along the length of the board, as well as having the means for securement of the shoe or boot to the binding being adjustable for the length of the shoe or boot and/or the position on the snow board within the confines of the binding itself.

BACKGROUND OF THE INVENTION

Snow boards have become an increasingly popular wintertime recreation. As is well known, the snow board rider stands with his feet perpendicular or at an angle to the length of the board and maneuvers the board by shifting his weight, causing the board to tip and react against the snow, causing a curve.

Since the control of the board is translated through the feet of the rider, it is imperative that the feet be securely fastened to the board such that any movement will be translated directly to the board.

Since the edges of the board are the more critical aspect of the control, the movement of the rider must be transmitted to the edges, rather than along the center line, and the edge is further removed from the center line than in a standard ski.

Conventional snow board bindings are secured in pre-drilled holes generally along the center line of the snow board, thus creating severe torque when the rider's energy is transferred to the board and then translated outwardly toward the edge of the board.

Further, it is desirable for the rider of the snow board to be able to place his weight at a position along the length and width of the board which is most responsive to his or her style of boarding and, further, allowing some flexibility in angular positioning, as well as fore and aft positioning, to accommodate different riding styles.

A problem that exists in the prior art is that the snow board bindings are manufactured to a pre-determined standard, i.e. men's size 10 boot, making it virtually impossible for people with large or small feet to be adequately fitted upon the snow board. If such fitting does occur, it is very labor-intensive and time-consuming, with less than desirable results.

In summary, it is desirable to have a binding system which is fixedly secured to the board and perhaps is even an integral part of the board, wherein the connection between the board itself and the actual binding which is secured to the boot or shoe is such that the user can move the placement fore or aft along the board and, further, is capable of a great deal of flexibility in terms of the angularity of his or her feet to the board. In addition to the above, it is desirable to have the binding be such that it can be readily adjusted to accommodate different size boots which are comfortably fitted to different size feet.

In addition to the generalized statements hereinabove, prior art currently known to the inventors includes:

U.S. Pat. No. 4,264,087, granted to Bortoli, Apr. 28, 1981, which discloses a ski binding support wherein the binding is movable along the length of the ski by means of a longitudinal groove in the side of the ski and a clamping mechanism which secures the binding in position once the position has been selected.

U.S. Pat. No. 5,028,068, granted to Donovan, Jul. 2, 1991, discloses a means for mounting a binding to the top of a snow board wherein the binding is angularly adjustable and is secured in position by a tension cable which is secured or released by a lever handle. The bindings, when the lever is released, can be readily rotated about their axis along the center line of the board to the desired position and then locked in place by the cable tensioning system.

U.S. Pat. No. 5,035,433, granted to Kincheloe, Jul. 30, 1991, discloses a releasable foot binding for use in combination with snow boards, wherein a plate is secured to the typical shoe binding and the plate means is then slid into a track-like device having plate overlapping edges along each side and releasably locked in place, thereby securing the boot to the binding.

U.S. Pat. No. 5,354,088, granted to Vettor et al, Oct. 11, 1994, discloses a boot binding which has a plate mounted thereon which is secured to a turntable mounted upon the snow board such that the user can determine the preferred angularity of the position and then secure the position by a pin dropping through the plate into the turntable.

U.S. Pat. No. 5,417,443, granted to Blattner et al, May 23, 1995, discloses a snow board binding wherein the boot is generally cradled by a U-shaped binding which extends around the heel of the boot and does include some provision for adjustment of angle by utilizing different mounting holes for the binding and some adjustment in terms of the length and width of the binding.

DISCLOSURE OF THE INVENTION

With the above-noted prior art in mind, it is an object of the present invention to provide a snow board binding which is secured to the snow board along the opposite edges thereof such that the torque generated by the shifting weight of the rider is immediately transferred to the edge of the board.

It is another object of the present invention to provide a snow board binding wherein the securement means between the binding and the board are integral with the board.

Still a further object of the present invention is to provide a binding system wherein the system allows adjustment along the length of the snow board, allowing the rider to move his weight to a different portion of the board, allowing angular adjustment of an infinite degree within the limits of the binding for the user's feet once the position along the longitudinal axis of the board has been selected.

Still a further object of the present invention is to provide a snow board binding system wherein the binding may be quickly and easily adjusted to accommodate the different size boot of the wearer.

BEST MODE OF CARRYING OUT THE INVENTION

Figure 1:
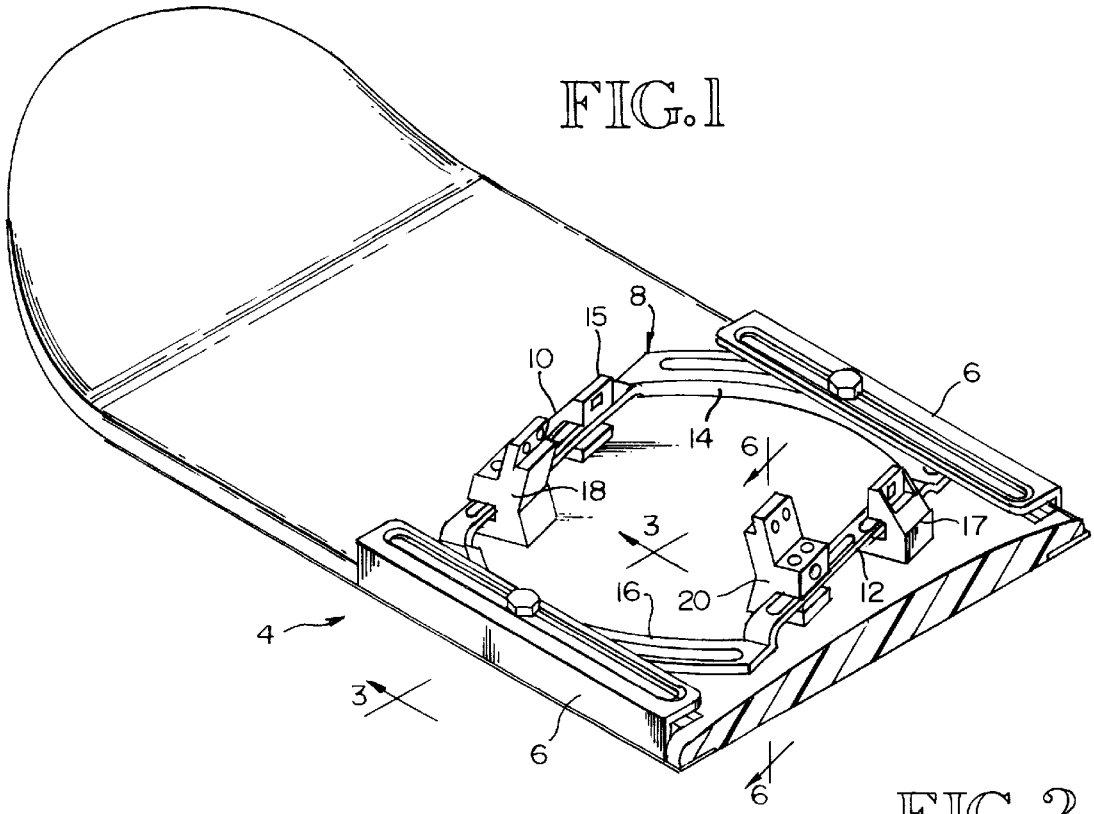
FIG. 1 is an isometric view of the front end of a snow board with the inventive binding in place, including means for securing the boot securing straps.

As seen in FIG. 1, a front end of a snow board 2 is shown with the front binding generally designated as 4 mounted thereto. As a general description, the binding 4 consists of a pair of side rails 6 having opposing inwardly facing openings along the length thereof which may be secured by molding into the side of the snow board 2, or made of a super high strength material such as carbon graphite, kevlar or the like, which would be integral with the snow board made of a similar material. Adjustably mounted within the side rail 6 secured within the inwardly facing openings is a mounting frame 8, comprising, as will be explained in greater detail hereinafter, a pair of parallel side rails 10, 12 and arcuate ends 14 and 16. It is to be noted at this point that there is a groove complementary to the respective edges in both the side portions and the end portions. Releasably and adjustably mounted to the side rails 10 and 12 are a pair of identical toe strap securement means 15, 17 and a pair of rear heel strap/stirrup securement means 18 and 20.

Figure 2:
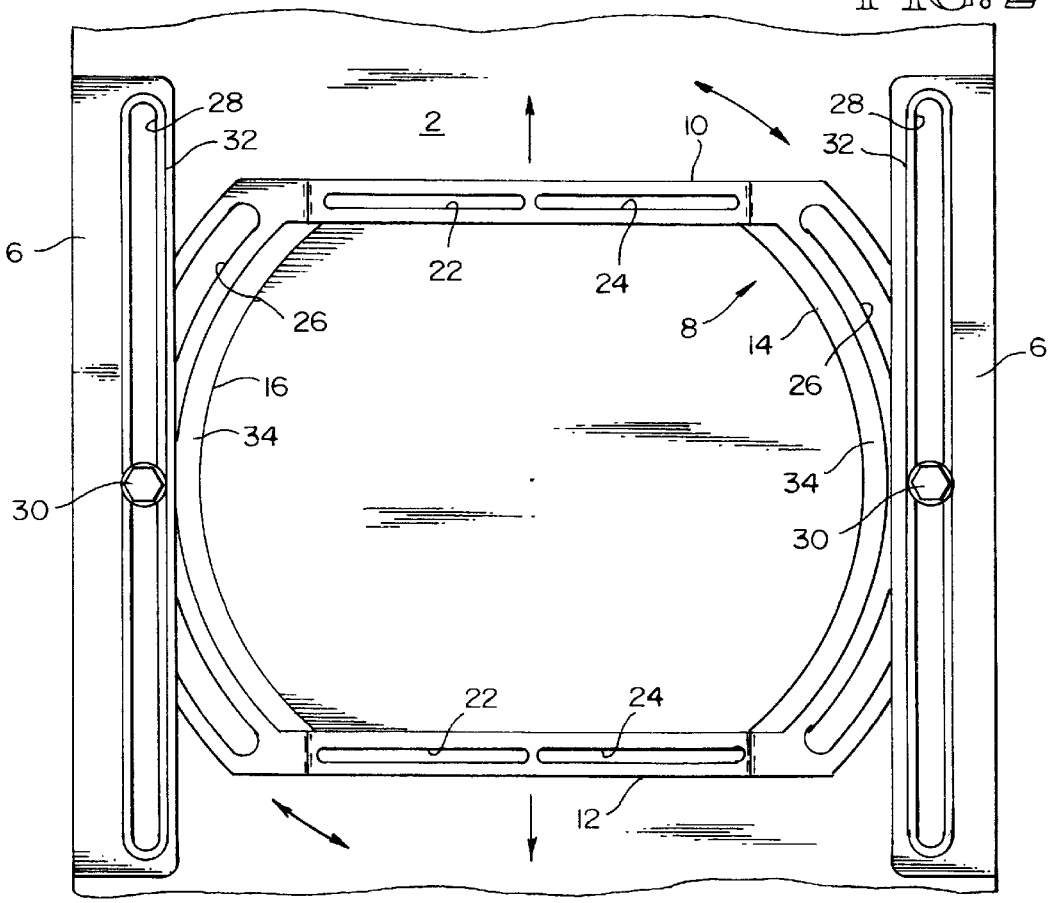
FIG. 2 is a top plan view of the binding of FIG. 1 sans the boots securement means.

Reference is now had to FIG. 2, wherein the interrelationship between the side rails 6 and the mounting frame 8 can more readily be seen. As seen in this view, sides 10, 12 of mounting frame 8 are parallel and include a pair of co-linear slots 22, 24 running parallel to the edges for the mounting of the securement devices 14, 16 and 18, 20, as explained hereinafter. The elements joining the side elements 10, 12 are curvilinear elements 14, 16 which are outwardly bowed and likewise each include a slot 26 which when mounted in place curves beneath the parallel slots 28 in side rail 6 for adjustable securement thereto by fastening means 30. It is to be noted that the slots 28 include a recessed portion at the upper edge thereof 32 to allow the slight recession of fastening member 30 or a captured washer. It is also to be noted that the curved end elements 14, 16 include an inwardly tapered portion 34 to provide a smooth transition from the surface of the snow board 2 and the binding itself. With the interrelationship of the frame mounting member 8 and the side rail 6, it should be readily apparent that the frame member may be moved longitudinally of side member 6 as well as being angularly adjustable such that the individual snow boarder can place his weight, within the bounds of the binding, along the longitudinal and latitudinal axis of the boar and, further, can adjust the angle at which his foot is placed relative to the board for relative comfort and control.

Figure 3:
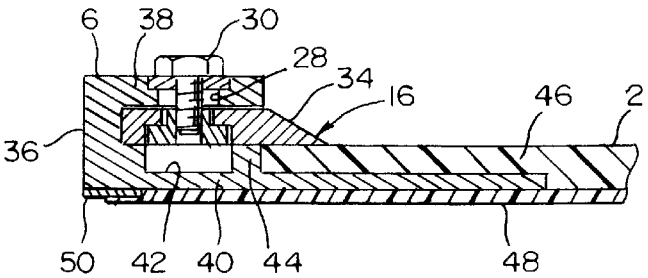
FIG. 3 is a section along line 3—3 of FIG. 1.

As seen in FIG. 3, each side rail 6 includes an outer vertical edge member 36 and inwardly extending top member 38 and inwardly extending bottom member 40, which includes a longitudinal groove 42 to capture the lower element of fastening member 30 and an upwardly extending ridge member 44 to support the edge portion of the mounting frame 8, as represented by the curvilinear end element 16 including slope 34. The bottom member extends inwardly beyond the edge of top member 38 and is intended to be laminated within the fiberglass upper layer 46 of snow board 2 and the lower snow contacting surface 48 which is terminated at its outer edge by a metal strip 50.

Figure 4:
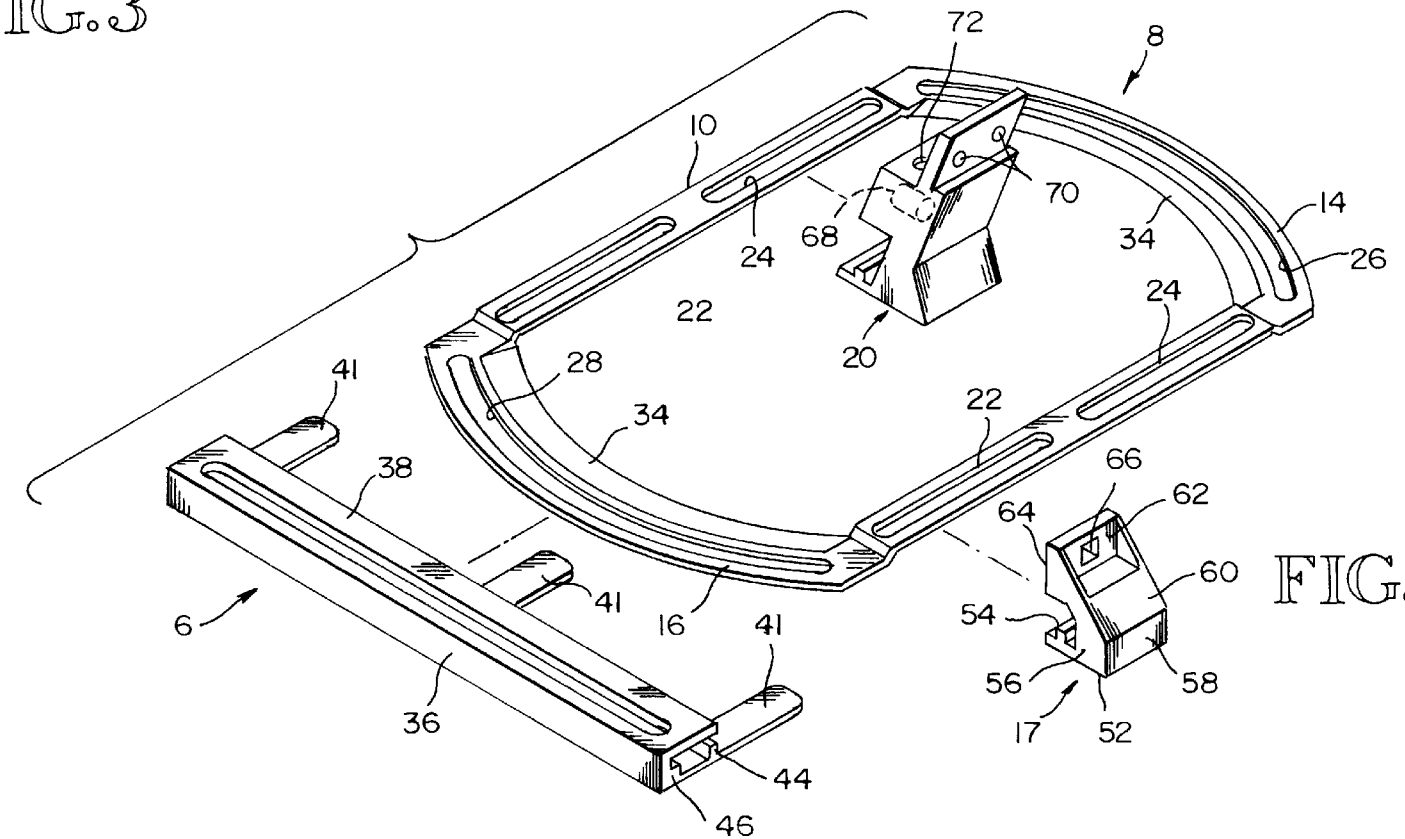
FIG. 4 is an exploded view of FIG. 1.

As seen in FIG. 4, the side element 6 is exploded from the mounting frame 8, and likewise the mounting elements themselves 16 and 20 are exploded from the mounting frame. The forward end or toe mounting element 16 includes a flat, rectangular bottom element 52 including at its upper surface a parallel upwardly extending ridge 54 for movement linearly along the slot 22 when captured between the upper surface of the board and frame 8. The sides 56 are generally parallel and the back includes a lower portion 58 generally perpendicular to the bottom 52 and then an inwardly sloping portion 60, terminating again in a flat portion 60 substantially parallel to the portion 58 and face 64 substantially parallel to 62, including an opening 66 to receive a fastener for securing the adjustable toe strap (not shown) which holds the rider's boot in position.

As can be readily seen, the interaction between the mounting frame 8 and the toe mounting element 16 allows the wearer to readily adjust the toe portion of the binding to accommodate different sized boots.

Reference is had to the rear binding element 20 which will be described in greater detail with respect to FIG. 6. However, it is to be noted in this figure that there is an inwardly open-threaded opening 68 to receive a fastening member for a strap which goes over the upper portion of the foot in contrast to the two through-openings 70 which are used to secure the heel stirrup and the downwardly threaded opening 72 to secure the element 20 in position along the side rail of the mounting frame.

Figure 5:
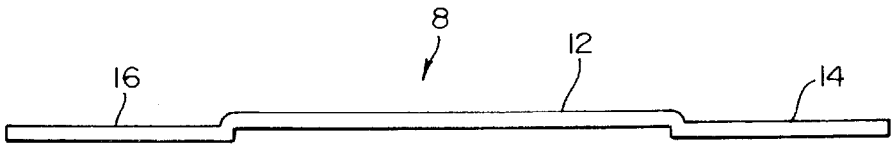
FIG. 5 is a side elevation view of the binding member of FIG. 4.

As seen in FIG. 5, a mounting frame 8 has the curved end portions 14, 16 in a lower and different plane than the side elements 10, 12 such that the strap securement members 16 and 20 may be removed from or adjusted along the slots 22, 24 to accommodate the rider. It is to be noted at this point that the mounting frame 8 may be removed completely from the side element 6 if it becomes necessary to replace the frame and/or the mounting elements very quickly and very easily.

Figure 6:
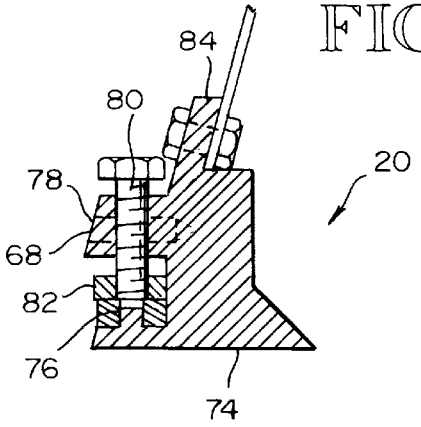
FIG. 6 is an elevation view along line 6—6 of FIG. 1.

Reference is now had to FIG. 6 wherein the heel securement unit 20 of the binding system may be seen. As seen in this view, the unit has a flat rectangular lower portion 74 to be in contact with the upper surface of the snow board. The inward extension of the bottom 74 supports a parallel ledge member 76 for interaction with the tract slot 24, and the upper portion extends upwardly and forwardly to form a lip 78 through which the threaded opening is made such that a threaded member 80 may be threaded into a congruently threaded member 82, such that a turning of the member 80 causes 82 to clamp downwardly upon the edges of slot 24, securing the element 20 in position. Likewise to be seen in this view is an upwardly angled element 84 to which the heel stirrup assembly is secured.

Thus, it can be seen that the loosening of element 80 allows the heel securement element to be moved along slot 24; and thus the combination of the capability of moving securement members 16 and 20 along slots 22, 24, respectively, allows a substantial adjustment in both the placement of the foot on the board and the size of the wearer's boot. This adjustability combined with the angular movement allows a great deal of flexibility in personalizing the board for comfort and control, it being understood that there is an identical binding system at the rear end of the board.

Figure 7:
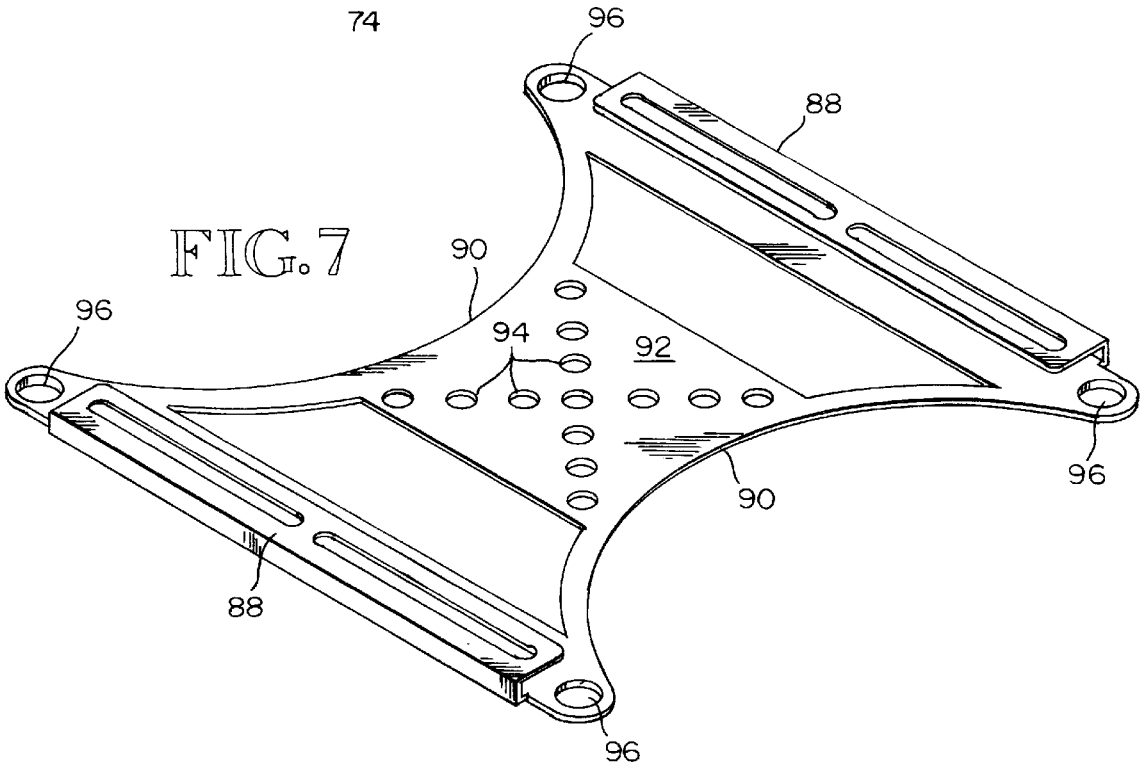
FIG. 7 is an isometric view of another species of the binding adapted to be secured to a snow board using the standard using the standard securement threaded bores as a locating device.

As seen in FIG. 7, it is anticipated that persons already owning snow boards or buying boards without the inventive binding on them may well wish to retrofit with a binding; therefore, a combination template side rail for converting a standard board to one which uses the inventive binding is shown in FIG. 7. As seen in this view, there is a substantially rectangular, relatively thin stainless steel element having a pair of parallel side elements including inwardly projecting upper ledge portions 88 which would replicate the upper portions of side elements 10, 12 integrally connected to a flat bottom portion which has inwardly curved cut-outs at 90 terminating in a bridging member 92 having a plurality of openings 94 punched therein to mate with the pre-drilled and threaded bores found in currently available snow boards such that the adapter plate can be properly located. Once properly located, the adapter is secured by threaded elements through bores 96 in the corners of the adapter element or optionally through threaded elements through bores 94.

Figure 8:
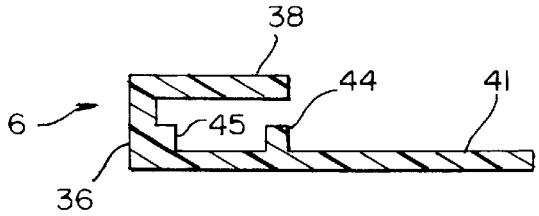
FIG. 8 is a sectional view of the side rail of FIG. 1.

FIG. 8 is a vertical section through the side element 6 showing more clearly the element 41 to be laminated within the snow board, the upper inwardly projecting ledge 38., the outer vertical surface 36 and the upwardly projecting ridge 44 which in conjunction with step 45 defines an area trapping the fastening element which passes through the curved portion 34 of mounting frame 8 allowing it to move in a linear and angular direction and yet allowing it to be clamped into position by fastening element 30 as seen in FIG. 3.

Thus, as can be seen, the present inventive binding system which could be used on snow boards, or perhaps even wave boards or other similar boards, provides an easily adjustable system which not only accommodates the position of the user along the length of the board, but likewise the angle at which the feet are placed relative to the board, and perhaps even more critically, allows an adjustment to accommodate the foot or boot of the wearer, whereas the existing bindings are generally manufactured to accommodate a men's size 10.

We claim:

1. A recreation board with a binding system, comprising:

a rigid strip mounted along each edge of the board, said strip including an inwardly open slot the length thereof;

a mounting frame including a pair of substantially parallel side members including slots therein and a pair of arcuate end members connected to said side members, including arcuate slots and lying in a different plane, slightly offset from the side members said arcuate end members adapted to be adjustably secured to the rigid strips along each of the edges of the board; and adjustable means for securing a rider's boots to the mounting frame whereby the position of the boot relative to the board may be adjusted.

2. A recreation board with a binding system, comprising:

a mounting frame adjustably secured to the board, said frame movable fore and aft along the board as well as angularly with the centerline of the board such that a rider's feet may be optimally placed for a particular riding style;

said mounting frame including a pair of substantially parallel side elements, including parallel elongated slots, joined by a pair of opposing arcuate end elements including arcuate slots such that the end elements may be secured adjacent an edge of the board, allowing angular adjustment of the frame; and shoe securing elements mounted in the parallel slots.

3. A binding as in claim 2, wherein the parallel side elements are in a different plane than the arcuate end elements, having a space under the side elements when the end elements are secured to the board, permitting easy adjustment of the shoe securing elements.

* * * * *